US008091287B2

(12) United States Patent
Rippolone

(10) Patent No.: US 8,091,287 B2
(45) Date of Patent: Jan. 10, 2012

(54) FORCED AIR HEATED GUTTER SYSTEM

(75) Inventor: Joseph D. Rippolone, Grosse Pointe Farms, MI (US)

(73) Assignee: Waterfall, Inc., Detroit, MI (US)

( * ) Notice: Subject to any disclaimer, the term of this patent is extended or adjusted under 35 U.S.C. 154(b) by 2052 days.

(21) Appl. No.: 10/787,429

(22) Filed: Feb. 26, 2004

(65) Prior Publication Data

US 2005/0210757 A1 Sep. 29, 2005

(51) Int. Cl.
*E04D 13/00* (2006.01)

(52) U.S. Cl. ..... 52/15; 219/213; 165/47

(58) Field of Classification Search ..... 52/11–16; 219/213; 165/47
See application file for complete search history.

(56) References Cited

U.S. PATENT DOCUMENTS

| | | | | | |
|---|---|---|---|---|---|
| 2,240,951 | A | * | 5/1941 | Hamjy | 237/1 R |
| 3,431,972 | A | * | 3/1969 | Bernardi | 165/47 |
| 3,795,271 | A | * | 3/1974 | Adamic | 165/47 |
| 3,821,512 | A | * | 6/1974 | Stanford | 219/213 |
| 3,823,304 | A | * | 7/1974 | Siemianowski | 219/213 |
| 3,824,749 | A | * | 7/1974 | Scherf | 52/11 |
| 4,043,527 | A | | 8/1977 | Franzmeier | |
| 4,110,597 | A | | 8/1978 | Elmore | |
| 4,252,183 | A | | 2/1981 | Ricciardelli | |
| 4,308,696 | A | * | 1/1982 | Schroeder | 52/11 |
| 4,375,805 | A | | 3/1983 | Weber | |
| 4,401,880 | A | | 8/1983 | Eizenhoefer | |
| 4,699,316 | A | * | 10/1987 | Johnson | 237/69 |
| 4,769,526 | A | * | 9/1988 | Taouil | 219/213 |
| 5,315,090 | A | * | 5/1994 | Lowenthal | 219/213 |
| 5,328,406 | A | * | 7/1994 | Morris et al. | 454/260 |
| 5,368,620 | A | * | 11/1994 | Chiba et al. | 96/414 |
| 5,391,858 | A | | 2/1995 | Tourangeau et al. | |
| 5,454,859 | A | * | 10/1995 | Chiba et al. | 96/18 |
| 5,501,716 | A | * | 3/1996 | Chiba et al. | 96/400 |
| 5,503,219 | A | | 4/1996 | Bortugno | |
| 5,836,344 | A | | 11/1998 | Hovi, Sr. | |
| 5,878,533 | A | * | 3/1999 | Swanfeld, Jr. | 52/11 |
| 5,900,178 | A | | 5/1999 | Johnsen | |
| 5,996,289 | A | * | 12/1999 | Allaster | 52/95 |
| 6,225,600 | B1 | * | 5/2001 | Burris | 219/213 |
| 6,700,098 | B1 | * | 3/2004 | Wyatt et al. | 219/213 |
| 6,708,452 | B1 | * | 3/2004 | Tenute | 52/11 |
| 6,727,471 | B2 | * | 4/2004 | Evans et al. | 219/213 |
| 6,759,630 | B1 | * | 7/2004 | Tenute | 219/213 |
| 6,875,954 | B2 | * | 4/2005 | DeBenedetto et al. | 219/213 |
| 6,978,577 | B2 | * | 12/2005 | Jones | 52/11 |

* cited by examiner

*Primary Examiner* — William Gilbert
(74) *Attorney, Agent, or Firm* — Carlson Gaskey & Olds, P.C.

(57) ABSTRACT

A forced hot-air gutter thawing system includes a multiple of gutter sections which each include a multiple of molded in hot air flow passages adjacent a liquid passageway. A hot air source such as a conventional hot-air type furnace communicates hot air through a manifold which distributes hot-air through the gutter sections to prevent ice and snow from blocking the liquid passageway. The gutter sections are assembled together through heat staking or other fastening arrangement such that the gutter sections may be combined in a modular manner to provide a gutter system for various dwellings.

4 Claims, 2 Drawing Sheets

FORCED AIR HEATED GUTTER SYSTEM

BACKGROUND OF THE INVENTION

The present invention relates to a gutter system, and more particularly to a molded gutter, which includes passages for forced hot air thawing.

It is commonly recognized that snow presents a particularly troublesome problem for buildings in colder climates. Snow usually accumulates on a roof and as the snow melts, water from the snow as it melts freezes in the gutters and may prevent water drainage from the roof. The reduction in drainage eventually may result in a complete blockage. Once the drainage from any portion of a roof is thus blocked, water may eventually back up under the roof and may then leak into the building.

Various conventional gutter heating arrangements are known. One system utilizes electrical systems that are draped within the gutter to melt accumulated ice and snow. Other systems utilized forced air hoses in a manner similar to the electrical arrangements. Disadvantageously, these conventional systems are installed into existing gutters and may create various aesthetic, routing, and installation difficulties. Furthermore, routing the heating elements within the gutter minimizes flow through the gutter and may create additional traps for debris, which may eventually disable liquid flow through the gutter.

Accordingly, it is desirable to provide an uncomplicated gutter system that minimizes accumulation of ice and snow.

SUMMARY OF THE INVENTION

The forced hot-air gutter thawing system includes a multiple of gutter sections which each include a multiple of molded in hot air flow passages adjacent a liquid passageway. A hot air source, such as a conventional hot-air type furnace, communicates hot air through a manifold that distributes hot air through the gutter sections.

Each gutter section is a plastic molded component within which the passages are directly molded. The passages are preferably located within a bottom portion of the gutter section below a conventional liquid passage arranged along the length thereof. The passages are redundant in that one or more passages may be utilized as intake passages and one or more passages may be utilized as return passages depending upon which are in communication with the manifold.

The gutter sections are assembled together through heat staking or other fastening arrangement such that the gutter sections may be combined in a modular manner to provide a gutter system for various dwellings.

The present invention therefore provides an uncomplicated gutter system that minimizes accumulation of ice and snow.

BRIEF DESCRIPTION OF THE DRAWINGS

The various features and advantages of this invention will become apparent to those skilled in the art from the following detailed description of the currently preferred embodiment. The drawings that accompany the detailed description can be briefly described as follows.

DETAILED DESCRIPTION OF THE PREFERRED EMBODIMENT

Figure 1:
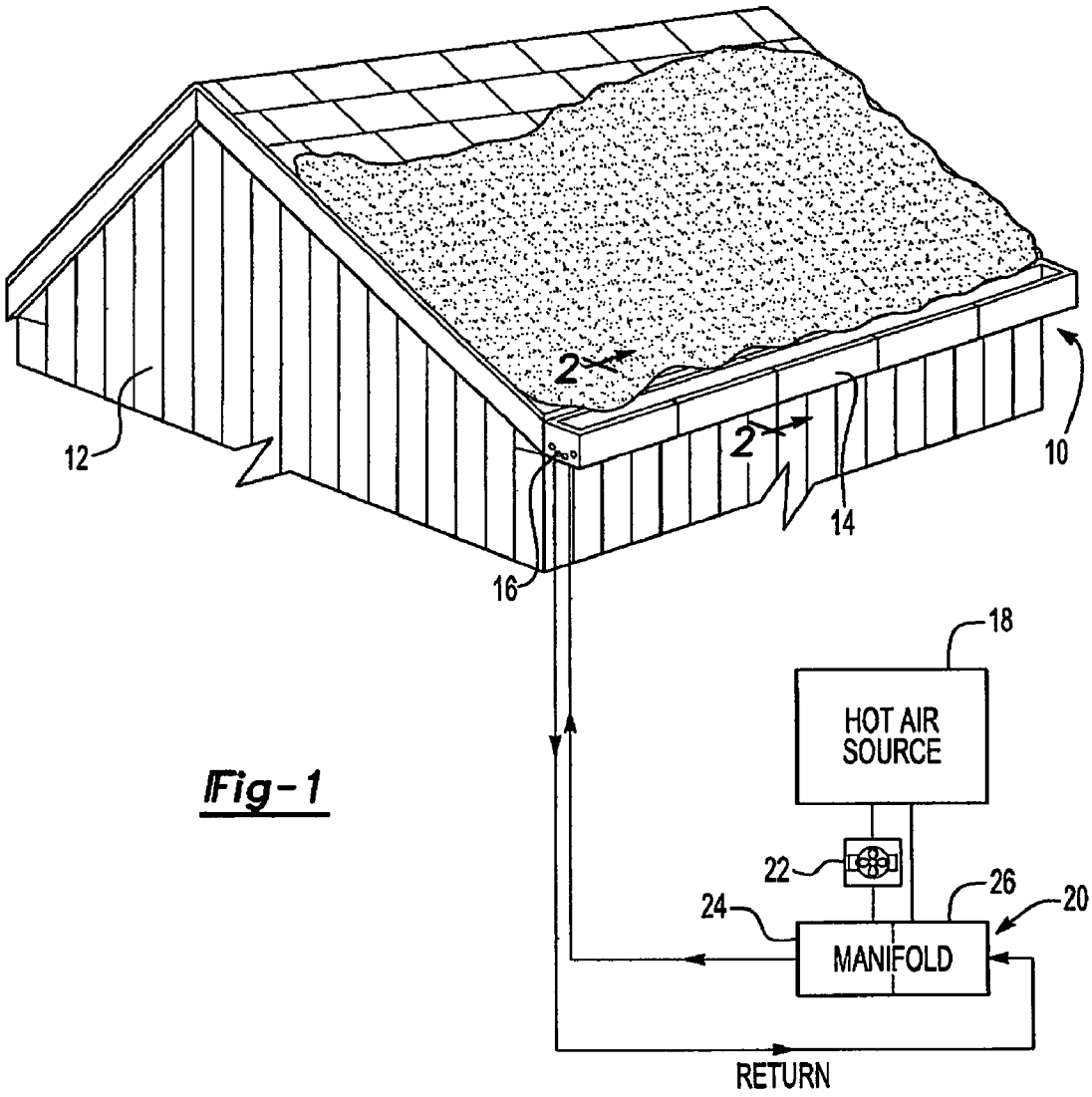
FIG. 1 is a general perspective view an dwelling for use with a forced hot-air gutter thawing system according to the present invention.

FIG. 1 illustrates a general perspective view of a forced hot air gutter thawing system 10. The gutter thawing system 10 is mounted to a structure 12 as is generally understood. It should be understood that although a particular structure and simplified gutter system component is disclosed in the illustrated embodiment, other arrangements will benefit from the instant invention.

Figure 2:
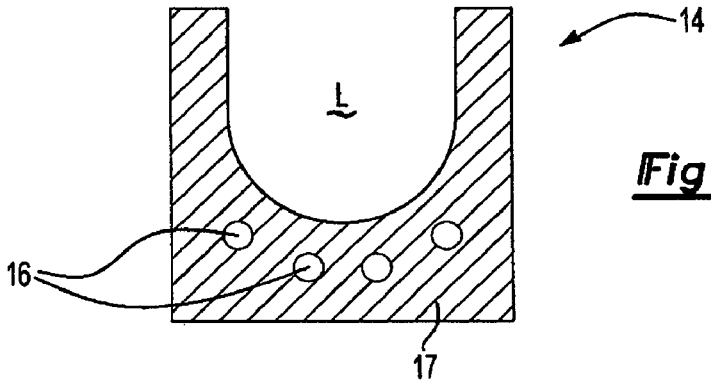
FIG. 2 is a sectional view of a gutter section.

The system 10 generally includes a multiple of gutter sections 14 which each include a multiple of molded in passages 16 (FIG. 2). A hot air source 18, such as a conventional hot air type furnace, communicates hot air through a manifold 20 that distributes hot air through the gutter sections 14. The manifold 20 is preferably arranged to permit a multiple of pneumatic communication paths from the source to the gutter sections 14.

Figure 3:
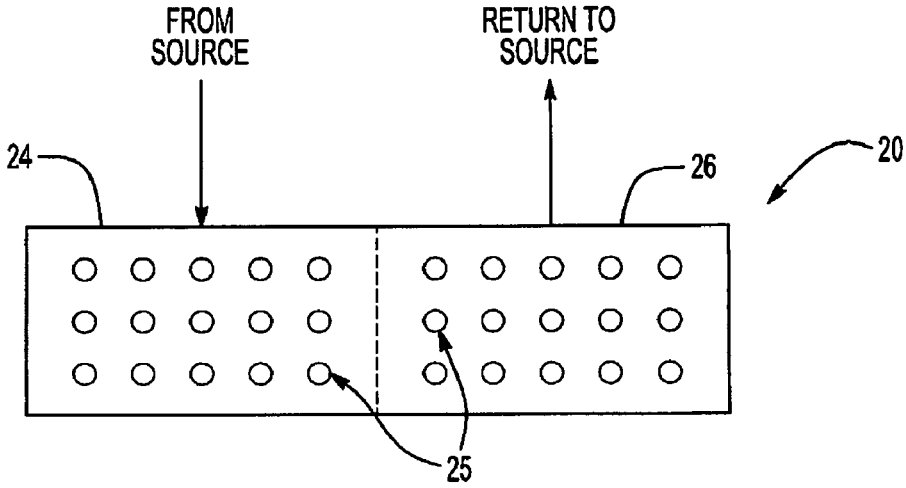
FIG. 3 is an schematic view of a manifold.

Preferably, a fan 22 or the like provides the hot air at a pressure above atmosphere to the manifold 20. The hot air is communicated through the gutter sections 14 and preferably returned to the manifold 20. The hot air is recirculated such that a minimal of hot air is lost and the system efficiency is maximized. It should be understood that a multiple of recirculation circuits may be utilized within a single dwelling. Preferably, the manifold 20 includes a pneumatic return section 24 and a pneumatic output section 26 (FIG. 3) with a multiple of connectors 25 to accommodate a multiple of circuits through selective connection thereto.

Referring to FIG. 2, one gutter section is illustrated in cross-section. Preferably, each gutter section 14 is a plastic molded component within which the passages 16 are directly molded. The passages 16 are preferably located within a bottom portion 17 of the gutter section 14 below a conventional liquid passage L along the length thereof. The passages 16 are preferably redundant in that one or more passages may be utilized as intake passages and one or more passages may be utilized as return passages depending upon which are in communication with the manifold 20.

Figure 4:
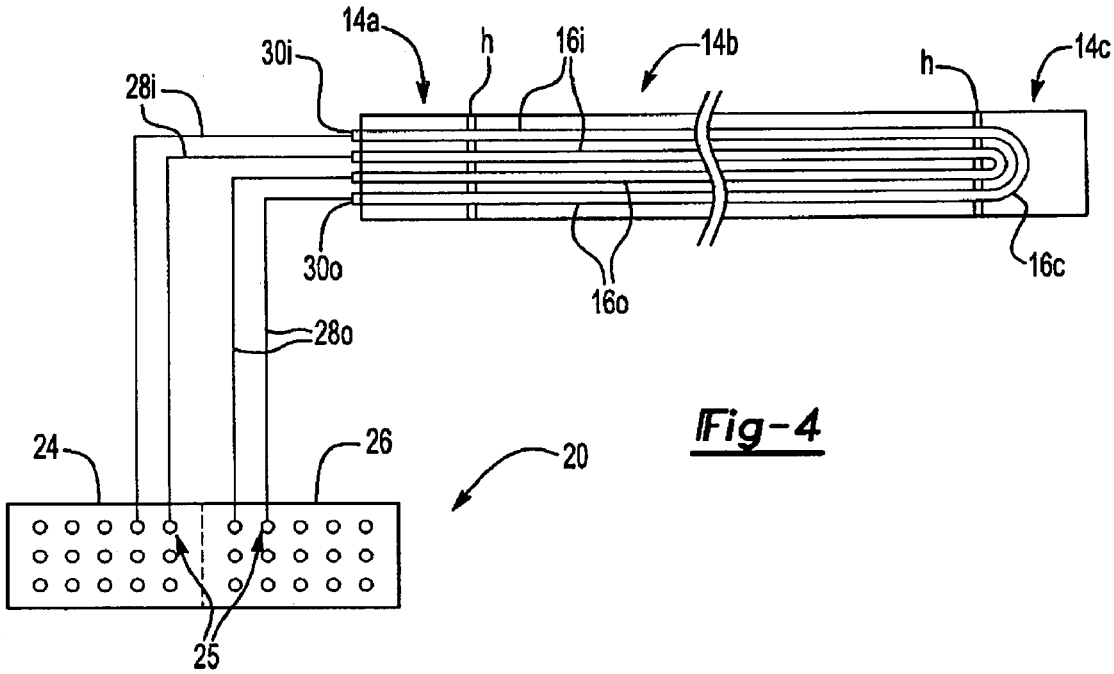
FIG. 4 is a schematic top view of multiple gutter sections in a representational system arrangement.

Referring to FIG. 4, a multiple of gutter sections 14*a*-14*c* are illustrated. It should be understood that although three sections are illustrated, the general schematic arrangement of a much more complicated gutter systems, which is built through modular arrangements of these and other gutter sections, will be understood by one of skill in the art with the benefit of the teaching provided herein. The gutter sections 14*a*-14*c* are preferably assembled together through heat staking h or other fastening arrangement such that the gutter sections may be combined in a modular manner to provide a gutter system for various dwellings.

The gutter section 14*a* is a communication section that is connected with the manifold 20 by conduits 28*i* and 28*o*, such as hoses or pipes. Connectors 30*i* and 30*o* connect the respective conduits 28*i* and 28*o* to the gutter section 14*a*. The connectors 30*i* and 30*o* may be threaded or provide another type of connection to the manifold 20 though the conduits 28*i* and 28*o*. The conduit 28*o* provides communication between the pneumatic output section 26 of the manifold 20 and the connectors 30*o* (i.e., input connectors) to provide a forced hot air flow into one or more of the passages 16*o*. The conduit 28*i* provides communication between the pneumatic return section 24 of the manifold 20 and the connectors 30*i* (i.e. return connectors) to return the forced hot air from one or more of the passages 16*i* to the pneumatic return section 24.

The gutter section 14*b* is a relatively straight section typically installed along a roof edge or the like. The gutter section 14*b* includes generally linear passages 16*o*, 16*i*. The gutter section 14*b* can be of any length, shape, and size.

The gutter section 14*c* is a return section which operates as an end cap or turn-around gutter section. The gutter section 14*c* includes a multiple of curved passages 16*c* which connect one or more input passages 16*i* to one or more output passages 16*o*. The gutter section 14*c* may alternatively or additionally plug one or more passages.

It should be understood that various passage arrangements will benefit from the present invention and that although only the three sections 14*a*-14*c* are illustrated other sections of other configuration will benefit from the instant invention and increase the modularity of the system.

The foregoing description is exemplary rather than defined by the limitations within. Many modifications and variations of the present invention are possible in light of the above teachings. The preferred embodiments of this invention have been disclosed, however, one of ordinary skill in the art would recognize that certain modifications would come within the scope of this invention. It is, therefore, to be understood that within the scope of the appended claims, the invention may be practiced otherwise than as specifically described. For that reason the following claims should be studied to determine the true scope and content of this invention.

What is claimed is:

1. A gutter thawing system section comprising:

a first molded gutter section comprising a liquid passage and a first multiple of linear air flow passage adjacent thereto;

a second molded gutter section comprising a second multiple of non-linear air flow passages which connect at least two of said first multiple of linear air flow passages; and a third molded gutter section comprising an input connector and a return connector, said input connector in communication with at least one of said first multiple of linear air flow passages, and a said return connector in communication with at least one of said first multiple of linear air flow passages.

2. A gutter thawing system section comprising:

a first molded gutter section comprising a liquid passage and a first multiple of linear air flow passage adjacent thereto;

a second molded gutter section comprising a second multiple of non-linear air flow passages which connect at least two of said first multiple of linear air flow passages;

a third molded gutter section comprising an input connector and a return connector, said input connector in communication with at least one of said first multiple of linear air flow passages, and said return connector in communication with at least one of said first multiple of linear air flow passages; and a hot air supply in communication with said input connector and a return connector.

3. The gutter section as recited in claim 2, further comprising a manifold in communication with said hot air supply and said input connector and a return connector.

4. The gutter section as recited in claim 3, further comprising a fan to raise a pressure of an airflow from said hot air supply to said manifold to above atmosphere.

* * * * *